US005379694A

United States Patent [19]

Haek et al.

[11] Patent Number: 5,379,694

[45] Date of Patent: Jan. 10, 1995

[54] LATERAL REGISTER SYSTEM FOR PRINTING FORMS

[75] Inventors: Joseph Haek, Friedberg; Anton Neumeir, Mering, both of Germany

[73] Assignee: MAN Roland Druchmaschinen AG, Offenbach am Main, Germany

[21] Appl. No.: 163,823

[22] Filed: Dec. 8, 1993

[30] Foreign Application Priority Data

Dec. 10, 1992 [DE] Germany ..... 4241588.8

[51] Int. Cl.[6] ..... B41F 21/00

[52] U.S. Cl. ..... 101/415.1; 101/DIG. 36; 101/383

[58] Field of Search ..... 101/378,383–388, 101/409, 410, 415.1, 486, DIG. 36; 33/614, 617–621

[56] References Cited

U.S. PATENT DOCUMENTS

| | | | |
|---|---|---|---|
| 2,990,772 | 7/1961 | Fischetti | 101/415.1 |
| 3,217,645 | 11/1965 | Martt | 101/415.1 |
| 3,281,946 | 11/1966 | Walsh | 33/618 |
| 4,009,659 | 3/1977 | Schneider | 101/378 X |
| 4,557,196 | 12/1988 | Köbler | 101/415.1 |
| 4,748,911 | 6/1988 | Köbler | 101/378 |
| 4,970,955 | 11/1990 | Sondergeld et al. | 101/409 |
| 5,016,531 | 5/1991 | Schroeder | 101/415.1 |
| 5,186,108 | 2/1993 | Hillebrand | 101/415.1 |

FOREIGN PATENT DOCUMENTS

| | | | |
|---|---|---|---|
| 0246977 | 11/1987 | European Pat. Off. | 101/415.1 |
| 0229892 | 3/1991 | European Pat. Off. . | |
| 226251 | 8/1985 | German Dem. Rep. . | |
| 2213614 | 3/1973 | Germany . | |

*Primary Examiner*—Edgar S. Burr
*Assistant Examiner*—Christopher A. Bennett
*Attorney, Agent, or Firm*—Cohne, Pontani, Lieberman, Pavane

[57] ABSTRACT

A lateral register system, in particular for flexible printing forms which are held by their edges in an axially extending gap in a plate cylinder, the edges being prebent according to the inclination of the gaps. The register system includes an insert strip for each printing form, which insert strip can be inserted into the gap and has at least one stationary register pin. When a plurality of printing forms are to be held in a common gap, the insert strips have different lengths and can be placed one on top of the other so that each printing form can cooperate with the register pin provided for it. Each insert strip can be adjusted individually in the axial direction of the plate cylinder by an adjusting system.

9 Claims, 2 Drawing Sheets

LATERAL REGISTER SYSTEM FOR PRINTING FORMS

BACKGROUND OF THE INVENTION

1. Field of the Invention

The invention is directed to a lateral register system, in particular for flexible printing forms which are held by their edges in axially extending gaps in a plate cylinder, these edges being pre-bent according to the inclination of these gaps.

2. Description of the Prior Art

At least one gap which is inclined at a determined angle is provided in the plate cylinder in order to fasten flexible printing forms. The ends of the printing forms which are bent in a defined manner are inserted into this gap. A plate cylinder with an axially extending gap whose opening is inclined in the rotating direction of the plate cylinder and which receives the two ends of the printing form, i.e. the bent edges, is from DD 226 251, for example. If two or more printing forms are fastened in the plate cylinder in its circumferential direction, two or more gaps which are offset by 180° relative to one another must be provided in the circumferential direction. In so doing, the ends of the printing form are shaped so that they are held in the slots even at high printing speeds. To improve reliability of operation, the edge of the printing form inserted in the gap after the preceding edge has an additional edge which is designed so that the subsequently inserted edge is resiliently supported against the preceding edge in the gap.

A simple lateral register system is possible in the gap of the plate cylinder. The gap is penetrated vertically with respect to its lateral surfaces by positioning pins which are pressed into corresponding bore holes of the plate cylinder so as to terminate flush with the plate cylinder circumferentially. Of course, such a register system does not provide the possibility for lateral displacement of the printing forms on the plate cylinder.

However, a problem in rotary printing presses with a plurality of printing mechanisms arranged one after the other is that the paper webs to be printed vary in width during printing due to their quality and absorption of the moistening medium. This change in width can differ from one printing mechanism to another.

The register pins for two printing forms which are arranged adjacent to one another on a plate cylinder can be displaced axially by means of a lateral register system, as is already known from the European Patent EP 0 229 892 B1. For this purpose, the register pins are connected with a common adjusting screw by means of an adjusting rod or an adjusting tube via threads of different pitches. In this way, the register pins for two adjacently arranged printing forms can always only be adjusted at the same time and with a fixed gear ratio. It is not possible to adjust the individual register pins, and accordingly the individual printing forms, separately so as to take into account the changing paper parameters.

SUMMARY OF THE INVENTION

Accordingly, it is an object of the present invention to provide a lateral register system, particularly for flexible printing forms which are held in gaps of a plate cylinder, in which individual printing forms or printing forms arranged adjacent to one another on the plate cylinder can be axially adjusted individually.

Pursuant to this object, and others which will become apparent hereafter, one aspect of the present invention resides in a lateral register system in which an insert strip is provided for each printing form to be held in a gap of the plate cylinder. The insert strip is insertable into the gap and has at least one stationary register pin. When a number of printing forms are to be held in a single gap the insert strips have different lengths and can be placed one on top of tile other so that each printing form can cooperate with the register pin provided for it. An adjusting system is provided for individually adjusting each insert strip in an axial direction.

A plurality of printing forms arranged adjacent to one another along the width of the plate cylinder can be adjusted with respect to their lateral register completely independently from one another since an insert strip is provided for each printing form to be held in the gap of the plate cylinder. The insert strip is inserted into the gap and has the at least one stationary register pin. When a plurality of printing forms are to be held in a common gap the insert strips having different lengths are placed one on top of tile other so that each printing form can cooperate with the register pin provided for it. If the gap extends continuously in the axial direction from one end of the plate cylinder to the other, a lateral register system according to the invention can be used along each half of the width of the plate cylinder in a mirror-inverted manner with respect to the center of the plate cylinder. In a modern newspaper printing press, for example, eight individual printing plates are fastened on the plate cylinder in two groups of four adjacent to one another and with two at the circumference. In this case, for example, two gaps which are offset relative to one another by 180° along the circumference and extend over the entire width of the plate cylinder and eight insert strips including their adjusting systems can be provided.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
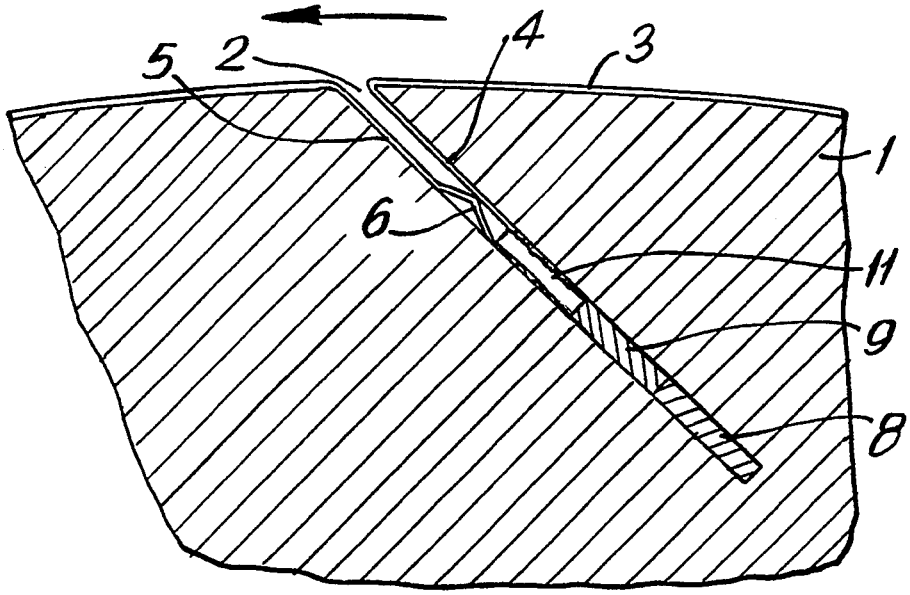
FIGS. 1 and 2 show a cross-section of a plate cylinder with a flexible printing form held in a gap and a lateral register system according to the invention.

According to FIG. 1, an axially extending gap 2 is arranged in the plate cylinder 1 with its opening inclined in the rotating direction of the plate cylinder 1, indicated by an arrow. Depending on the quantity and arrangement of the printing forms 3 on the circumference and along the width of the plate cylinder 1, the gap 2 can extend either along the entire width of the plate cylinder 1 or only over a partial area of its width. If two printing forms are to be fastened on the plate cylinder 1 in its circumferential direction on the same width, two gaps 2 which are offset relative to one another by 180° must be arranged in the circumferential direction.

The two edges 4, 5 of a printing form 3 resting on the circumference of the plate cylinder 1 are hung in the gap 2 of the plate cylinder 1 shown in the drawing. These edges 4, 5 are pre-bent according to the inclination of the gap 2. The preceding edge 4 is hung in the gap 2 at an acute angle. The resiliently deformed subsequent edge 5 is supported against the preceding edge 4 and thus prevents a lifting from the lateral surfaces of the gap 2, i.e. ensures a secure fit. The subsequent edge 5 is provided, for example, with an axially extending bead 6, 7, i.e. a trough-shaped bend, to increase operating reliability.

When inserting the edges 4, 5 into the gap 2, the bead 6 is deformed in the resilient area and pressure is exerted on the edges 4, 5 situated in the gap 2 so as to protect effectively against a throwing out of the edges even at high printing speeds. The beads 6, 7 can be shaped in different ways. The bead has a point 6 in FIG. 1 and a rounded shape 7 in FIG. 2. The bead 6, 7 can be stamped into the edge or can be welded or glued to the edge. A plurality of beads can be arranged one above the other on the edge and can also be arranged in or on the preceding edge 4 in a mirror-inverted manner.

Figure 2:
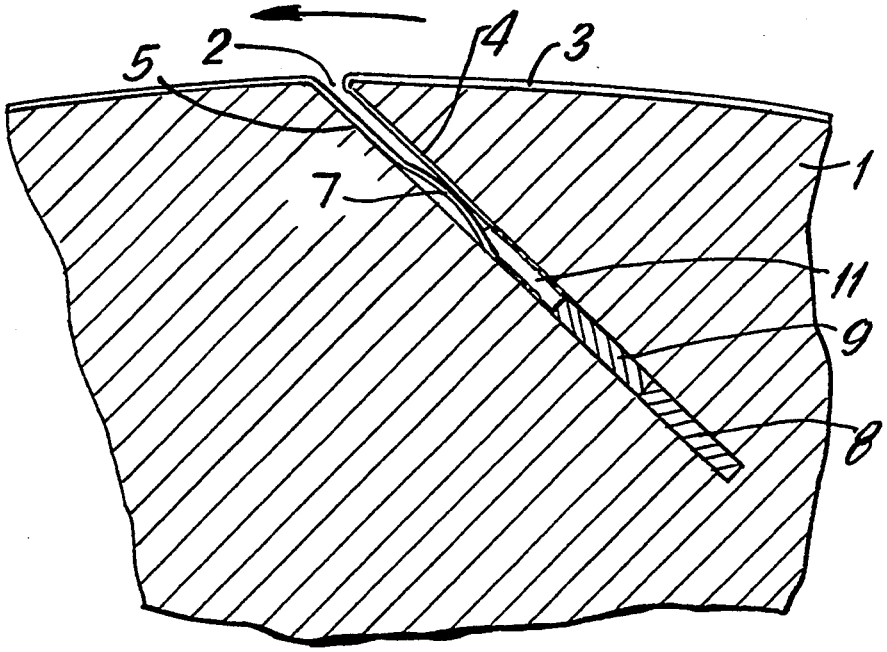

Further, two insert strips 8, 9 are placed one above the other in the gap 2 according to FIGS. 1 and 2. An insert strip 8, 9 with at least one stationary register pin 10, 11 is provided for each printing form 3 to be held in the gap. However, only the register pin 11 of the top insert strip 9 is visible in FIGS. 1 and 2.

Figure 3:
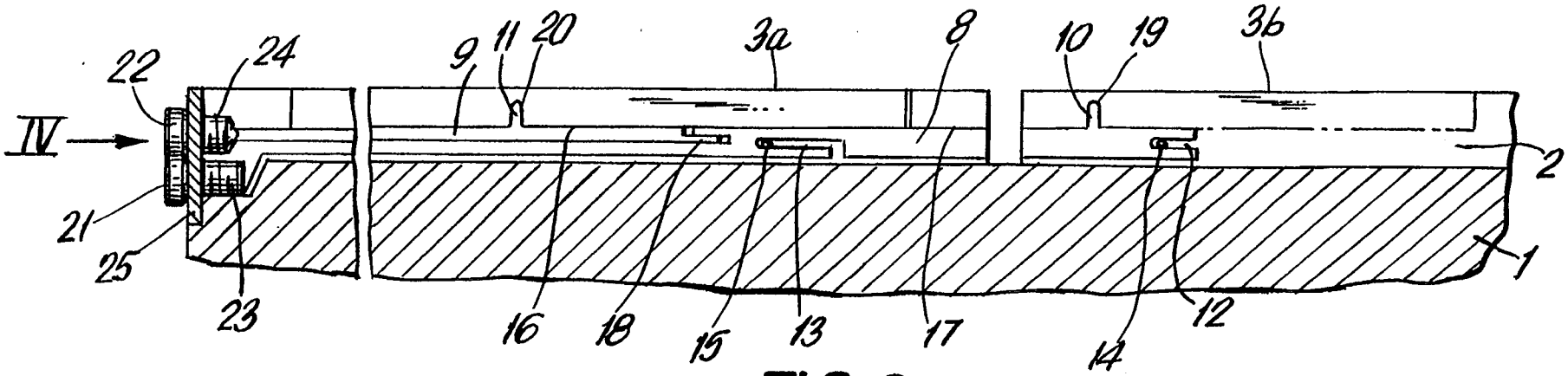
FIG. 3 is a view of a lateral register system, according to the invention, along a gap in the plate cylinder.

FIG. 3 shows the first insert strip 8 and the second insert strip 9 according to FIGS. 1 and 2 along the gap 2 of the plate cylinder 1 in which two axially adjacent printing forms 3*a*, 3*b* are clamped. The insert strips 8, 9 have different lengths. The bottom-most and longest first insert strip 8 has axially aligned elongated holes 12, 13. Fastening means 14, 15 of the plate cylinder 1 engage in the elongated holes 12, 13 to fasten the first insert strip 8 in the radial direction. However, the elongated holes 12, 13 are constructed so that the first insert strip 8 can be separated from the fastening means 14, 15 and threaded in again in the axial direction. The fastening means 14, 15 are constructed as pins which are pressed into corresponding bore holes of the plate cylinder 1 and are pressed in position by stud screws. The inlet of the stud screws at the surface of the plate cylinder 1 is ground or machined.

The shorter second insert strip 9 is located above a portion of the longer insert strip 8, as shown in FIG. 3, so that its upper edge 16, with the exception of the register pins 10, 11, is flush with the upper edge 17 of the insert strip 8 lying below it and thus forms an insert strip system with a common upper edge.

The shorter insert strip 9 can be fastened to the insert strip 8 lying below it by means of a tie 18 or a plug-in connection, but so as to be displaceable in the axial direction. Each insert strip 8, 9 has at its upper edge 16, 17 a stationary register pin 10, 11 which cooperates with corresponding recesses 19, 20 in the opposite edges 4, 5 of a printing form 3.

An adjusting wheel 21, 22 arranged at the end side of the plate cylinder 1 is provided for each insert strip 8, 9. Each adjusting wheel 21, 22 cooperates with a threaded pin 23, 24 connected with the respective insert strip 8, 9. The adjusting wheels 21, 22 are arranged on a fastening plate 25 which can be screwed to the end side of the plate cylinder 1 by fastening means, such as screws 26, 27.

The insert strips 8, 9 and, along with them, the register pins 10, 11 can be displaced laterally along the gap 2 by rotating the adjusting wheels 21, 22. In this way, each printing form 3*a*, 3*b* can be laterally aligned individually within the range of 1/100 mm. The construction of the lateral register system 8, 9; 10, 11; 21, 22; 23, 24 is very simply designed, economical to produce and easy to handle.

Figure 4:
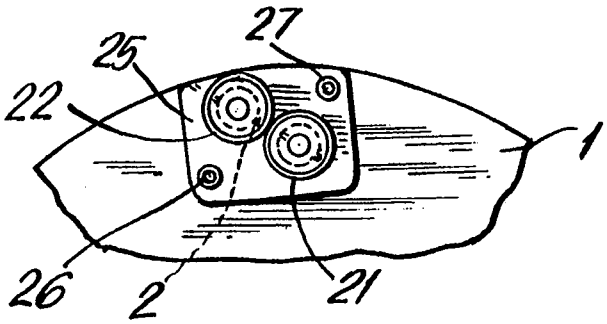
FIG. 4 is a view of the adjusting system for the insert strips in direction IV according to FIG. 3.

By loosening the two screws 26, 27 shown in FIG. 4, the entire lateral register system 8, 9; 10, 11; 21, 22; 23, 24 can be removed from the gap 2, e.g. for cleaning.

A particular advantage of the lateral register system 8, 9; 10, 11; 21, 22; 23, 24 according to the invention is that it can be used, even for an extremely narrow gap, for reducing groove shock and accordingly the vibrations of the machine without the need for additional machining of the plate cylinder, e.g., axial bore holes.

In a further advantageous construction of the invention, all insert strips 8, 9 are provided with a wear-resistant coating having a Vickers hardness HV of at least 2,500. A TiN coating is preferably used.

The invention is not limited by the embodiments described above which are presented as examples only but can be modified in various ways within the scope of protection defined by the appended patent claims.

We claim:

1. A lateral register system for a plurality of flexible printing forms which are held by their edges in an axially extending inclined in a plate cylinder having an end side, the edges being pre-bent according to the inclination of the gap, the lateral register system comprising: a separate insert strip provided for each of the printing forms to be held in the gap of the plate cylinder, the insert strips having at least one stationary register pin and being insertable into the gap so as to be movable in an axial direction of the plate cylinder; and means for individually adjusting each insert strip in the axial direction, the separate insert strips provided in the gap having different lengths and being placed one on top of the other so that each printing form can cooperate with the register pin provided for it.

2. A lateral register system according to claim 1, wherein the adjusting means includes a plurality of threaded pins, each pin connected with a respective insert strip, and a plurality of adjusting wheels arranged at the end side of the plate cylinder, each adjusting wheel cooperating with one of the threaded pins connected with a respective insert strip so that each insert strip is individually adjustable.

3. A lateral register system according to claim 1, and further comprising fastening means for retaining all the insert strips in the gap.

4. A lateral register system according to claim 3, wherein the insert strips include a first longest insert strip that has axially aligned elongated holes and is fastened radially relative to the plate cylinder by the fastening means engaging in the elongated holes, the insert strips further including a shorter insert strip placed on top of the first insert strip and a plug-in connection for fastening the shorter insert strip to the first insert strip so as to be displaceable in the axial direction.

5. A lateral register system according to claim 4, wherein the insert strips which are placed one over the other in the gap form an insert strip system which, with the exception of the register pins, has a common upper edge extending in a line.

6. A lateral register system according to claim 1, wherein the insert strips are provided with a wear-resistant coating having a Vickers hardness HV of at least 2,500.

7. A lateral register system according to claim 6, wherein the wear-resistant coating is a TiN coating.

8. A lateral register system according to claim 2, and further comprising means for releasably attaching the adjusting means to the end side of the plate cylinder.

9. A lateral register system according to claim 4, wherein the plate cylinder has bore holes, the fastening means including pins engagable into the bore holes in the plate cylinder.

* * * * *